US005107715A

United States Patent [19]

Thuries

[11] Patent Number: 5,107,715

[45] Date of Patent: Apr. 28, 1992

[54] CIRCUIT BREAKER DRIVE MECHANISM

[75] Inventor: Edmond Thuries, Pusignan, France

[73] Assignee: Gec Alsthom SA, Paris, France

[21] Appl. No.: 707,181

[22] Filed: May 24, 1991

Related U.S. Application Data

[63] Continuation of Ser. No. 446,956, Dec. 6, 1989, abandoned.

[30] Foreign Application Priority Data

Dec. 9, 1988 [FR] France ..... 88 16220

[51] Int. Cl.[5] ..... G05G 17/00

[52] U.S. Cl. ..... 74/2; 185/40R; 200/400

[58] Field of Search ..... 74/2; 185/40 R; 200/400; 251/71

[56] References Cited

U.S. PATENT DOCUMENTS 3,845,433 10/1974 Kraulits ..... 200/400 X
3,898,409 8/1975 Liebig et al. ..... 185/40 R X
4,152,562 5/1979 Kohler et al. ..... 200/400
4,240,300 12/1980 Tanaka ..... 74/2

FOREIGN PATENT DOCUMENTS 402543 7/1966 Australia ..... 200/400

*Primary Examiner*—Allan D. Herrmann
*Attorney, Agent, or Firm*—Sughrue, Mion, Zinn, Macpeak & Seas

[57] ABSTRACT

The invention relates to controlling a circuit breaker by means of a drive mechanism circuit for operating a circuit breaker by rotating a main operating shaft (4). The drive mechanism comprises a trigger circuit breaker drive mechanism (1) delivering considerably less power than that required for operating the circuit breaker, and associated with an assembly including a disengagement first spring (6), an engagement second spring (12), and a recocking motor (14) for recocking the springs which are disposed, on being released, to drive the main shaft (4) through 180°, with the release of the springs being controlled by motion of an outlet member (2) of the trigger drive mechanism (1). The invention is applicable to the operating circuit breakers.

6 Claims, 2 Drawing Sheets

CIRCUIT BREAKER DRIVE MECHANISM

This is a continuation of application Ser. No. 07/446,956 filed Dec. 6, 1989 now abandoned.

The present invention relates to a circuit breaker drive mechanism, in particular for use with a high tension or a very high tension circuit breaker.

BACKGROUND OF THE INVENTION

Control mechanisms of the mechanical type (using springs), of the pneumatic type and of the hydraulic type are known for operating circuit breakers, in particular for performing an OFO cycle (open, rapid close, open again).

A mechanical drive mechanism is described, for example, in U.S. Pat. No. 4,240,300.

At present, the drive mechanisms available deliver energy up to a maximum of about 3000 Joules. Recent circuit breakers require drive mechanisms that deliver much larger quantities of energy, about ten times the maximum energies currently available.

Research, development, and manufacture of a new drive mechanism of such high power would require considerable investment.

An object of the invention is to use a presently-available low power drive mechanism of very low cost and to adapt it to driving a high power circuit breaker.

SUMMARY OF THE INVENTION

The present invention provides a drive mechanism for operating a circuit breaker by rotating a main operating shaft, wherein the drive mechanism comprises a trigger circuit breaker drive mechanism delivering considerably less power than that required for operating said circuit breaker, and associated with an assembly including a disengagement first spring, an engagement second spring, and a recocking motor for recocking said springs which are disposed, on being released, to drive said main shaft through 180°, with the release of the springs being controlled by motion of an outlet member of said trigger drive mechanism.

BRIEF DESCRIPTION OF THE DRAWINGS

An embodiment of the invention is described by way of example with reference to the accompanying drawings, in which.

DETAILED DESCRIPTION

Figure 1:
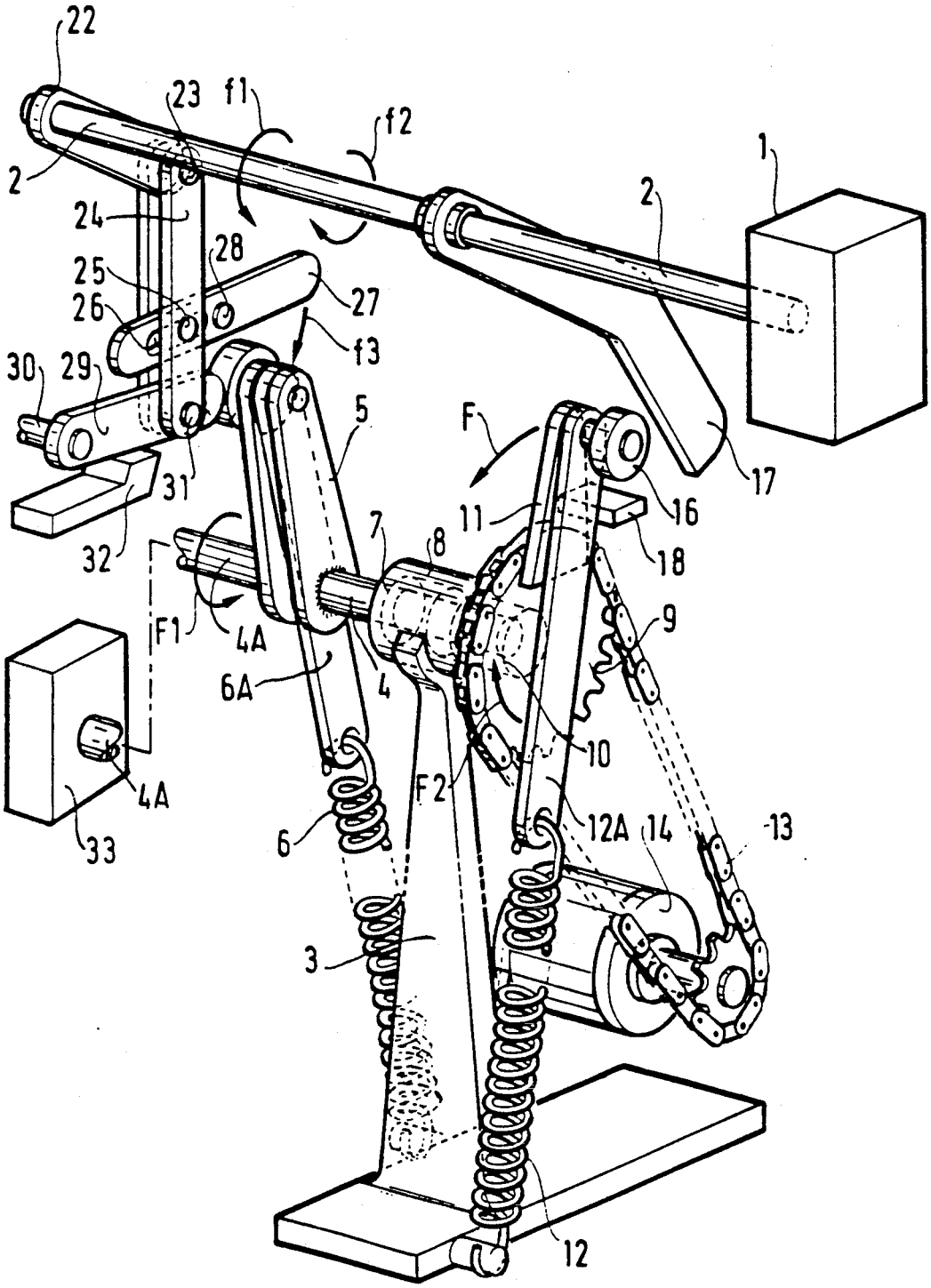
FIG. 1 is a diagrammatic perspective view of a drive mechanism of the invention.

In FIG. 1, the block referenced 1 represents a conventional type of circuit breaker drive mechanism which may be mechanical, hydraulic, or pneumatic. The assumption is that this drive mechanism is much less powerful than is required for actuating the circuit breaker to be operated. That is why this conventional drive mechanism is used for triggering a mechanism described below which is capable of storing and releasing the required amount of energy. The trigger control mechanism is capable of performing an operation corresponding to opening or disengaging the circuit breaker 33 by rotating an outlet member of the drive mechanism which is a trigger shaft, in the direction of an arrow f1 about its axis, and an operation corresponding to closing or engaging the circuit breaker 33 by rotating the shaft 2 in the opposite direction (arrow f2).

The trigger shaft is thus used for triggering a mechanism or assembly 34 capable of delivering sufficient power to operate the circuit breaker 33 in question.

The mechanism comprises a fixed frame 3 supporting a main drive shaft or operating shaft 4 which controls the operating members of the circuit breaker (not shown).

A first arm 5 is fixed on one section of the shaft 4 and a second arm 5A is fixed to a second section 4A of shaft 4, with one end of the arm 5 being fixed to a disengagement spring 6 via a rod 6A, through which shaft 4 passes.

In the position shown in the figure, the first arm 5 is in its high position and the spring is taut, having stored sufficient energy for disengagement purposes.

Via a ball bearing 7, the shaft 4 carries a sleeve 8 fixed to a sprocket wheel 9. A freewheel on one-way clutch type of mechanism 10 between the main drive shaft portion 4A and the sleeve 8 enables the shaft 4 to be driven in the direction of arrow F1 when the wheel 9 is driven in the same direction, while preventing the shaft 4 and the sleeve 8 from rotating in the opposite direction.

A second arm 11 is fixed to the sprocket wheel 9 and the sleeve 8.

A rod 12A is fixed to the end of the arm 11 and has one end of a spring 12 fixed thereto whose other end is fixed to the base of the frame 3. In the position shown in the figure, the arm 11 is in its high position and the spring 12 is taut, having stored sufficient energy for simultaneously engaging the circuit breaker and for recocking the disengagement spring 6.

The sprocket wheel 9 is connected by a chain 13 to a cocking motor 14.

During cocking, the wheel 9 rotates in the direction of arrow F2, thereby driving the arms 5, 5A and 11.

The arm 11 is provided with a wheel abutment 16 cooperating with a cam 17 (engagement abutment) fixed to the trigger shaft 2.

A fixed abutment 18 prevents the arm from rotating in the direction opposite to the arrow F1.

The arms 5, 5A carry a wheel abutment 20 co-operating with a lever 29 (disengagement abutment) forming a portion of a small mechanical assembly comprising a small crank 22 fixed to the trigger shaft and articulated at 23 to a connecting rod 24 which is articulated at 25 to a slot 26 in a lever 27 having a stationary pivot axis 28, and a crank 29 pivoting about a stationary pivot axis 30 and articulated at 31 to one of the ends of the connecting rod 24.

The drive mechanism operates as follows:

When the system for protecting the grid or line in which the circuit breaker 33 is inserted issues an instruction for opening the circuit breaker, the trigger drive mechanism acts to rotate the shaft 2 in the direction of arrow F1.

The crank 22 pivots entraining the connecting rod 24 and pulling the crank 29 which disengages the abutment 20.

The spring 6 acts, driving the arm 5 which causes the shaft 4 to rotate through 180° in the direction of arrow F1, thereby opening the circuit breaker.

Figure 3:
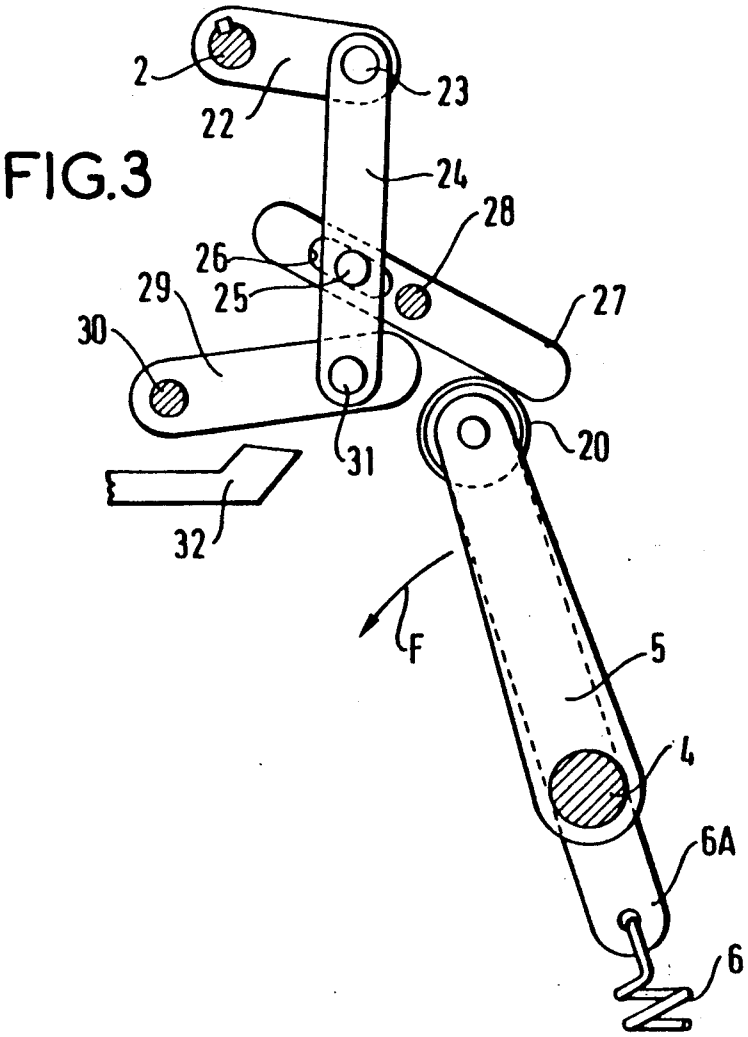
FIGS. 2 and 3 are diagrams for explaining how the circuit breaker is tripped.

It may be observed that during this operation, the lever 27 pivots about the axis 28 in the direction of arrow f3 and strikes the wheel 20, thereby accelerating the motion of the rod 6A and consequently the rotation of the shaft 4 and thus the opening operation of the circuit breaker (FIG. 3).

The trigger drive mechanism then receives the "close" instruction which causes the trigger shaft 2 to rotate in the direction of arrow f2. The cam 17 then pushes the wheel abutment 16 against the arm 11 which, after going through top dead center, is driven by the spring 12. The arm 11 rotates the shaft 4 through 180° in the direction of arrow F, thereby re-engaging the circuit breaker.

Simultaneously, the shaft 4 rotates the arms 5, 5A and thus recocks the spring 6. An abutment 32, e.g. made of elastomer, absorbs the contact shock between the wheel 20 and the crank 29.

In order to be able to recock the spring 6, the spring 12 must deliver a greater force.

A circuit breaker "open" instruction (for terminating the open, close, open cycle) causes the trigger shaft to rotate in the direction of arrow f1, and as before this releases the spring 6 and causes the main shaft 4 to rotate.

Both arms 5, 5A and arm 11 are then in the low position. The drive mechanism is then recocked by means of the motor 14. The motor rotates the sprocket wheel 9 through 180° in the direction of arrow F2, thereby recocking the spring 12 arm 11 coming into abutment against the abutment 18, and also rotating the shaft 4 through 180°, thereby rotating the arms 5, 5A and recocking the spring 6.

Figure 2:
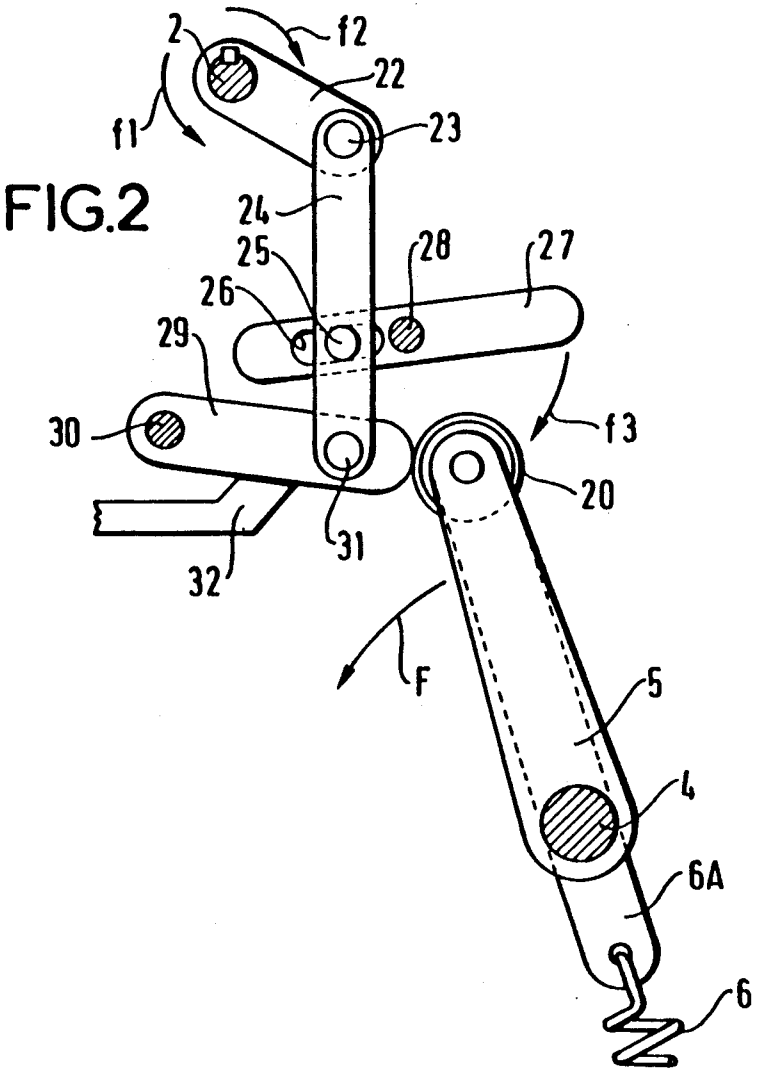

The wheel 20 comes into abutment against the crank 29 which has returned to its position shown in FIG. 2 since the circuit breaker drive mechanism 1 is recocked simultaneously.

By virtue of the invention, a high power circuit breaker is driven at low cost.

I claim:

1. A drive mechanism for operating a circuit breaker by rotating a main drive shaft, said drive mechanism comprising a trigger circuit breaker drive mechanism delivering considerably less power than that required for operating said circuit breaker including an outlet member, means operatively associating said trigger circuit breaker drive mechanism with an assembly, said assembly including a disengagement first spring, an engagement second spring, and a recocking motor for recocking said springs, and means for disposing said springs such that on being released, said springs drive said main drive shaft through 180°, and means for controlling release of the springs by a movable outlet member of said trigger drive mechanism, and wherein a fixed frame supports the main drive shaft, a first arm is fixed to said main drive shaft and having a first end of said disengagement spring fixing thereto, means fix the other end of said disengagement spring to the frame, and a second arm is provided and constrained to rotate with said main shaft by a freewheel mechanism allowing said main drive shaft to rotate in one direction only both for disengagement and for engagement, said engagement spring is fixed between the end of said second arm and a fixed point on the frame, the two arms have a position in which both springs are taut, with the ends of said first and second arms coming into abutment against a disengagement abutment and an engagement abutment respectively, and means responsive to motion of the outlet member of said trigger drive mechanism for respectively retracting said abutments.

2. A drive mechanism according to claim 1, wherein the second arm is fixed to a recocking wheel rotated by the recocking motor.

3. A drive mechanism according to claim 1, wherein said outlet member of said trigger drive mechanism is a trigger shaft rotatable about a shaft axis.

4. A drive mechanism according to claim 3, wherein the disengagement abutment is constituted by a first crank operatively engagable with a wheel fixed to the end of the first arm, said first crank having a stationary pivot axis and being articulated to a connecting rod, said connecting rod being articulated to a second crank, and said second crank being fixed to the trigger shaft and rotatable therewith.

5. A drive mechanism according to claim 4, wherein a lever having a stationary axis of rotation is articulated to said connecting rod, and said lever having an end imparting a shock to said wheel during rotation of said trigger shaft at the beginning of a disengagement operation of the circuit breaker.

6. A drive mechanism according to claim 3, wherein the engagement abutment is constituted by a cam fixed to said trigger shaft and rotatable therewith.

* * * * *